US005275397A

United States Patent [19]

Heddon

[11] Patent Number: 5,275,397

[45] Date of Patent: Jan. 4, 1994

[54] BOWLING LANE CONSTRUCTIONS AND REFINISHING METHODS

[76] Inventor: Will Heddon, 1422 Chamberlain Loop, Lake Wales, Fla. 33853

[21] Appl. No.: 12,166

[22] Filed: Jan. 29, 1993

Related U.S. Application Data

[63] Continuation-in-part of Ser. No. 681,052, Apr. 5, 1991, Pat. No. 5,183,262.

[51] Int. Cl.[5] ..... A63D 1/00

[52] U.S. Cl. ..... 473/117

[58] Field of Search ..... 273/51

[56] References Cited

U.S. PATENT DOCUMENTS

| | | | |
|---|---|---|---|
| 4,205,842 | 6/1980 | Murrey, Sr. | 273/51 |
| 4,795,152 | 1/1989 | Suiter | 273/51 |
| 5,183,262 | 2/1993 | Heddon | 273/51 |

*Primary Examiner*—William H. Grieb
*Attorney, Agent, or Firm*—Allen, Dyer, Doppelt, Franjola & Milbrath

[57] ABSTRACT

A bowling lane construction includes synthetic panels having a tab and a notch cut formed along the side surface of each panel and attached to a bowling lane substructure with fasteners. The panels are juxtaposed so that the tab of one panel fits into the notch of an adjacent panel. A clear flexible sheet is attached to the juxtaposed panels with an adhesive. A hardened finishing coat is applied to the sheet to provide a sliding surface. The sheet functions as a barrier layer between the finishing coat and the top surface of the panel so that the bowling lane may be refinished by peeling the sheet from the panel. A foul line joint coupler is provided to connect a wood or synthetic approach panel to a synthetic bowling lane. A compressible insert is used with panel fasteners and ensure that the tops are flush with the top surface of the corresponding panel. Shims under the coupler and the adjacent lane panel are used to control the height of both when top portions of the approach panel are successively removed at spaced time intervals.

16 Claims, 4 Drawing Sheets

BOWLING LANE CONSTRUCTIONS AND REFINISHING METHODS

BACKGROUND OF THE INVENTION

This application is a continuation-in-part of application Ser. No. 07/681,052 filed Apr. 5, 1991, now U.S. Pat. No. 5,183,262.

The present invention relates to constructs for bowling lanes which allow for a precise construction while providing a lane surface that is resistant to wear and easy to maintain.

There are several types of synthetic bowling lanes on the market today, many of which evolved from techniques developed by General Electric Company. Some of these techniques use a 1⅛-inch thick phenolic impregnated plastic laminate sheet having a decorative panel, with the surface of the sheet appearing as a wooden bowling lane. The laminated sheet is attached with contact cement to the surface of the old lane and becomes the bowling surface.

A main drawback to this technique is that the laminate sheet often does not adhere properly to an underlying wood lane. In addition, the wood lane often moves, causing the sheet on top to crack or separate.

In dealing with this problem, it is known to attach a thick phenolic panel to the underlying wood lane with screws in the ball drop area within the first four to five feet of the approach area. The laminate sheet is then placed on top of the thick phenolic panel. A particle board having the same thickness as the phenolic panel is placed on the balance of the lane, and is also screwed down to the wood lane. A printed plastic sheet is then placed on the top of the thick panel and sheet.

This technique is very expensive and requires numerous manufacturing steps. Another drawback is that when oil is placed on the lane, the oil often seeps between the panels and contaminates the particle board, making the joints swell. Moisture also seeps into the joints and contacts the particle board, causing the lanes to swell beyond acceptable American Bowling Congress tolerances. Further, a jacking effect is occasionally created where one surface of the approach panel actually rides up onto a lane panel, resulting in the edges along the seam of the panels being uneven. If one panel becomes higher than the other, a hazard to bowlers may result.

Another drawback to the aforementioned techniques is that when a solid phenolic is used as a lane surface, that portion of the lane using the phenolic is not totally free from warpage. This warpage is due to moisture and other different characteristics of the materials that result in bending or twisting at the joints. Again, these problems may become so severe that the joints exceed the tolerances of the American Bowling Congress over the entire surface of the lane. This problem is further compounded when panels of different materials are abutted against each other.

Many of the existing bowling lanes are constructed with 48-inch wood paneling in the approach area and 42-inch wood paneling in the lane area, with a foul line extending across the lane to separate the approach and lane areas. One such foul line includes a flat fiber material that extends downwardly along the surface of the lane. This foul line is typically glued or fastened onto the side surface of the foul lane and the approach area. When a bowling ball is successively dropped on the lane adjacent the foul line, a small groove may form in the lane. Over time, the groove may become larger requiring that the lane be repaired or replaced. Further, the location of the wood panels abutting the foul line tend to shimmy, also necessitating repair of the lane.

Synthetic lanes such as phenolic tend to be less susceptible to shimmying, however, synthetic lanes may be more expensive than natural wood. Further, current techniques for replacing old wood lanes with synthetic lanes require that the old approach area be replaced. When the player bowls on a synthetic approach panel, the feel to the player as a result of sliding on a synthetic panel may be different from the feel to the players than sliding on a wood approach panel. The feel of sliding on the wood approach panel is preferred.

When a synthetic lane is constructed, it is attached to a subsurface using screws. Once attached, a removable synthetic flat top dowel is placed snugly in a circular aperture that partially extends into the surface of the lane panel over the top of the screw to provide a smooth bowling surface. However, due to excessive vibrations that can occur when a bowling ball hits the lane, the dowels have a tendency to loosen and pop up, requiring that the lane be periodically serviced to push the dowels back in place.

In U.S. Pat. No. 5,084,318, there is disclosed a bowling lane construction utilizing dowels of a material which is the same as that of the synthetic panel. Other prior art of interest includes the following United States patents: U.S. Pat. Nos. 4,795,152 and 4,944,514 to Suiter; U.S. Pat. Nos. 4,205,842, 4,205,843 and 4,244,570 to Murray; U.S. Pat. No. 3,014,722 to Green; U.S. Pat. No. 2,531,168 to Snyder; U.S. Pat. No. 3,670,049 to Stein et al; U.S. Pat. No. 4,801,143, 4,269,411, 4,354,678, 4,169,602 and 4,421,309, all to Heddon.

SUMMARY OF THE INVENTION

Among the objectives of this invention is the provision of improved bowling lane constructions and related methods.

One objective of this invention is to provide a lane with a sheet and finish on the lane's surface which is unable to expand and contract to a point where a phenolic base layer is affected.

An additional objective of the invention is a bowling lane construction that has no special approach panel or melamine surfaces, and which uses standard off-the-shelf phenolic panels that are cut to size to provide protection from scarring on the melamine.

A further objective of the invention is to place a sheet on the lane surface with an adhesive permitting the sheet to be removed at a later time without damaging the underlying lane surface.

It is also a objective of the invention to use stepped joints so that adjacent panels may not slide up and down to create a joint or a seam.

Another objective is to provide a joint coupler between adjacent panels so that a smooth joint is maintained, and to place a sheet over the joint coupler to prevent moisture or contaminants from seeping into the joints and to maintain the lane within acceptable tolerances.

Another objective of the invention is to construct a lane with a wood strip that prevents shimmy at adjacent panels after extensive bowling lane use.

An additional objective of this invention is to construct a lane having a foul line coupler that attaches the approach panel, and which can be re-positioned vertically with the lane panel at successive time intervals.

A further objective of the invention is to provide a compressible fastening system, to control the height of screw fastener.

These and other objectives are accomplished by construction methods which comprise the steps of providing a first elongated panel, such as an approach panel, having a top surface, a bottom surface and an edge extending in a straight line from one side of the panel to the other. A notch is formed in the first panel along one of the surfaces adjacent the edge, so that the edge forms a tab between the top and bottom surface. A second elongated panel, for example a lane panel, is provided having a top surface, a bottom surface and an edge extending in a substantially straight line from one side of the panel to the other. A notch is then formed in the second panel along one of the surfaces adjacent the edge, so that the edge forms a tab between the second panel's top and bottom surfaces. The panels are juxtaposed so that the tab of the first panel inserts into the notch of the second panel and the tab of the second panel inserts into the notch of the first panel to form a joint that prevents the lane from exceeding tolerances during use.

In the preferred form, the bowling lane is provided with a plastic film or sheet attached to the top surface with a layer of contact adhesive secured to one side of the film. A coat of finishing material is then applied to the exposed side of the film so that this lane finish material may be removed easily when refinishing.

According to another method of this invention, the above objectives are accomplished in a method of refinishing a bowling lane by carrying out the steps of attaching a plastic film with contact adhesive secured to one side of the film to a top surface of a synthetic bowling lane. The other side of the film is then coated with a liquid finish that cures to form a hardened surface on the plastic film surface. It is preferable that the hardened surface may be removed from the lane by peeling the plastic film off the top surface of the lane to provide a barrier layer for the top surface. Thus the hardened surface may easily be removed without damaging the lane's surface.

Another construction technique of this invention is the use of a bowling lane substructure, a synthetic bowling lane panel with a top surface, and a plurality of apertures penetrating into the top surface. A screw is disposed within each aperture and attaches the lane to the substructure. A dowel is inserted into the aperture over each screw. The dowel maintains a friction fit against the sides of the aperture, and has a top surface substantially in alignment with the bowling panel top surface, with the sheet attached to the top surface of the dowel and the panel for preventing the dowels from popping out when the bowling lane is in use.

In another embodiment, a method for constructing a bowling lane includes the steps of providing an approach panel having a top surface with a step formed along one side of the approach panel's sides and with a J-shaped foul line coupler between the approach panel and an adjacent lane panel. The J-shaped coupler abuts against the side of the approach panel within the step so as to form a continuous flat surface with the top surface of the approach panel and the top surface. A step in the lane panel is inserted into an open portion of the J-shaped coupler to form a continuous flat surface with the top surface of the J-shaped coupler and the top surfaces of the lane panel and the approach panel. The J-shaped coupler holds the approach panel in place while remaining fastened to the approach panel.

Another form of this technique within the scope of this invention is used with a bowling lane comprising an approach panel having a top surface and a step formed into the panel along a first of the panel's sides. Abutting the approach panel is a coupler having a bottom portion, a riser portion and a top portion. The bottom portion rests on the step formed into the approach panel. The riser portion in cross-section extends along the panel's first sides in an angle substantially perpendicular to the bottom portion. The coupler also has a top portion that extends away from the riser and s id panel parallel to the bottom portion. The bowling lane also includes a lane portion having a top surface with a step formed into the lane panel along one of the lane panel's sides. The lane panel step is coupled to the coupling such that a continuous flat surface is formed along the top surface of the approach panel, the coupling and the lane panel. Accordingly, the approach panel in a bowling lane may be constructed from either wood or synthetic, and the lane panel may be constructed from a synthetic material such as phenolic.

In a preferred form, the bowling lane construction of the present invention employs a compressible insert used with the panel fasteners to control the depth of the fasteners and ensure that the tops are flushed with the top surface of the corresponding panel. Further, shims are provided under the coupler and the adjacent lane panel to control the height of both, so that when top portions of the approach panel are successively removed at spaced time intervals (as, for example, when the lane is being refinished) then shims may be removed to lower the height of both the coupler and the adjacent lane panel.

DESCRIPTION OF THE PREFERRED EMBODIMENTS

Figure 1:
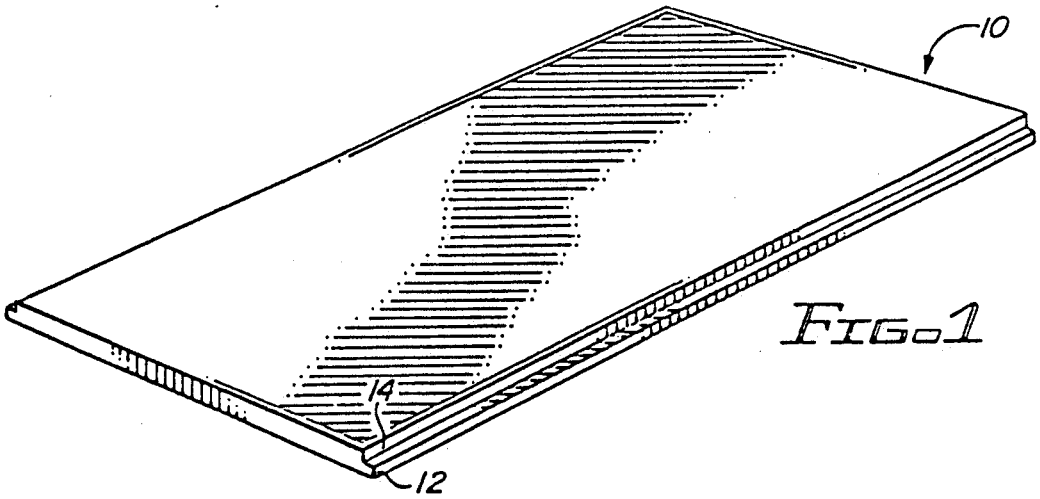
FIG. 1 is a perspective view of an approach panel used in constructing a bowling lane with a step joint along the outer perimeter of the panel
Figure 2:
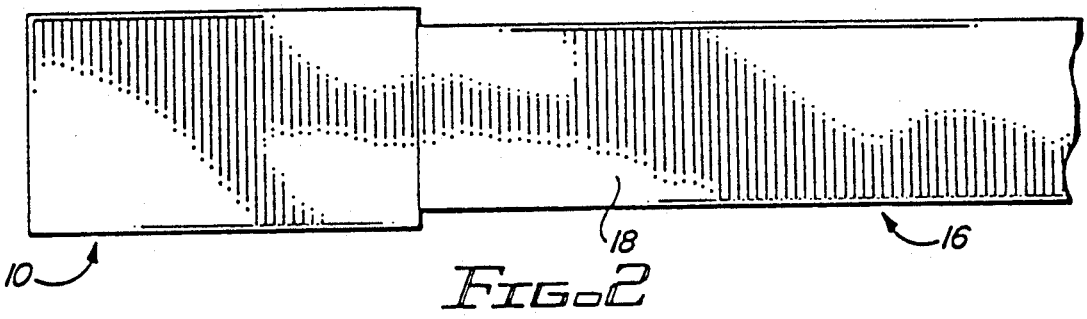
FIG. 2 is a top view of a portion of a bowling lane displaying an approach section and a portion of the lane section.
Figure 3:
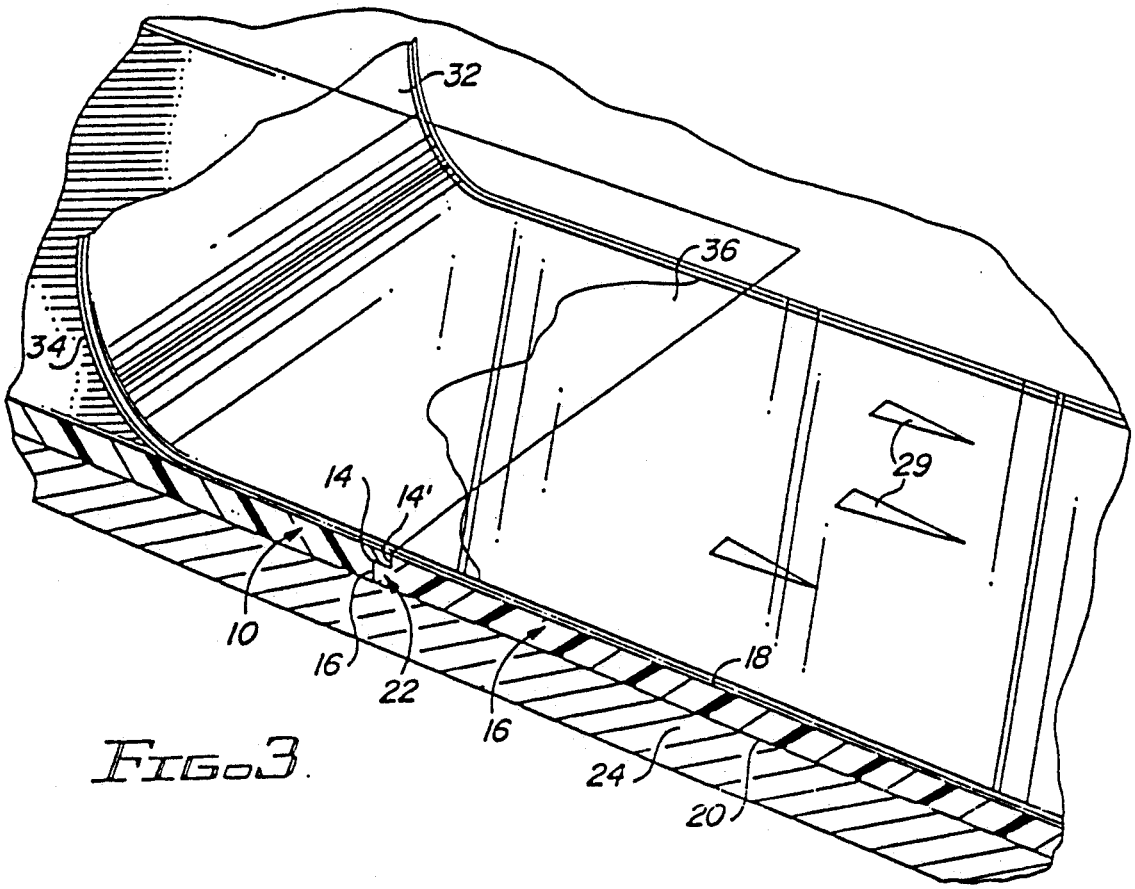
FIG. 3 is a cross-sectioned side view of a bowling lane having a film coating and a lane finish.

Referring first to FIGS. 1-3, there is shown an approach panel 10 that includes the approach area and the sliding area of the lane. The approach panel 10 is preferably forty-eight inches wide and eight feet long. The approach panel 10 is preferably constructed using a ¼ inch to ¾ inch phenolic core. The approach panel 10 includes a tab 12 that runs along three sides of the perimeter of approach panel 10. Cut out of approach panel 10 is notch 14 which extends adjacent tab 12 along the edge of approach panel 10. Notch 14 and 14' (FIG. 3) extends approximately halfway up the side of the panel. Tab 12 and notch 14 form a step joint 22 (FIG. 3) when coupled to adjacent approach panel 10 or adjacent lane panel 16 (FIG. 2 and FIG. 3).

As shown in FIG. 2 and FIG. 3, the approach panel 10 is coupled to a elongated lane panel 16 which is preferably forty-two inches two wide with an eight to twelve foot length with a ¼-inches inch to ¾-inch phenolic core. Elongated lane panel 16 is juxtaposed to approach panel 10.

Referring to FIG. 3, elongated lane panel 16 has a top surface 18 and bottom surface 20. Disposed at each end of lane panel 16 is a notch 14' and tab 12'. Notch 14' of elongated lane panel 16 mates with the tab 12 of approach panel 10 and tab 12' of adjacent lane panel 16. The tab 12' of elongated lane panel 16 mates with the notch 14 of approach panel 10 and adjacent lane panel 16 when lane panel 16 is juxtaposed to panel 10. Notches 14 and 14' and tabs 12 and 12' of adjacent panel 16 are juxtaposed to form step joint 22 to maintain joint separation within the American Bowling Congress tolerances.

Elongated lane panel 16 and approach panel 10 are coupled together through step joint 22. Lane panel 16 and approach panel 10 are mounted to a substructure 24 with screws (not shown). This substructure 24 may be any existing lane. Substructure 24 may not be required in constructing a new lane.

The bowling alley lane is constructed by attaching both the elongated lane panel 16 and the approach panel 10 onto substructure 24. Lane markings 28 are then applied to top surface 18 of elongated lane panel 16. The markings 28 are preferably attached to the lane using contact tape. However, other methods of constructing markings may also be used, including etching the marking 28 into the panel itself. Once markings 28 have been placed on top surface 18 a clear flexible plastic film barrier 32, having a contact adhesive 34, is applied to one side of the film barrier 32. The adhesive 34 is applied between the film barrier 32 and the approach panel 10 or lane panel 16. A preferable method of applying plastic film barrier 32 to panels 10 or 16, is similar to the method of applying plastic film to a floor as described in U.S. Pat. Nos. 4,795,152, 4,867,816 and 4,944,514, which are hereby incorporated by reference. The thickness of the plastic is also preferably the same thickness as the film described in the aforementioned patents.

Once plastic film barrier 32 has been extended over the lane panel 16 and approach panel 10, a lane finish material 36 may then be applied over film barrier 32. Examples of lane finishes include HONOR ROLL, manufactured by Polymetrics, Inc. of Maitland, Fla. and U300, manufactured by Perry-Austen of Des Moines, Iowa. Other lane finishes include a top coat of urethane with a slip agent such as silicon glyceride, or epoxies with good plastic film adhesive characteristics. The lane finish material 36 provides the proper resistance to bowling bowls when rolling over the lane. It is preferable that the lane finish that is used be applied as a liquid and then cured to form a integrally hardened finish.

Plastic film barrier 32 is thus used as an inner layer so as to allow the permanent hardened lane finish material 36 to be easily removed when refinishing the lane. Once the lane finish material 36 has been placed over plastic film barrier 32, the lane is ready for use. It is recognized that through time, this hardened lane finish will become scratched and scuffed up and thus will have to be replaced. This lane finish material 36 is easily removed by peeling up film barrier 32 from approach panel 10 and lane panel 16. Once film barrier 32 has been removed, the adhesive 34 may easily be cleaned from the phenolic with known adhesive-removing solvents. Once the lane has been cleaned, a new plastic film barrier 32 is placed on the lane and a new lane finish material 36 is coated over the film barrier 32. It is contemplated that the ease of which this lane finish material 36 is removed provides advantages in lane refinishing.

Figure 4:
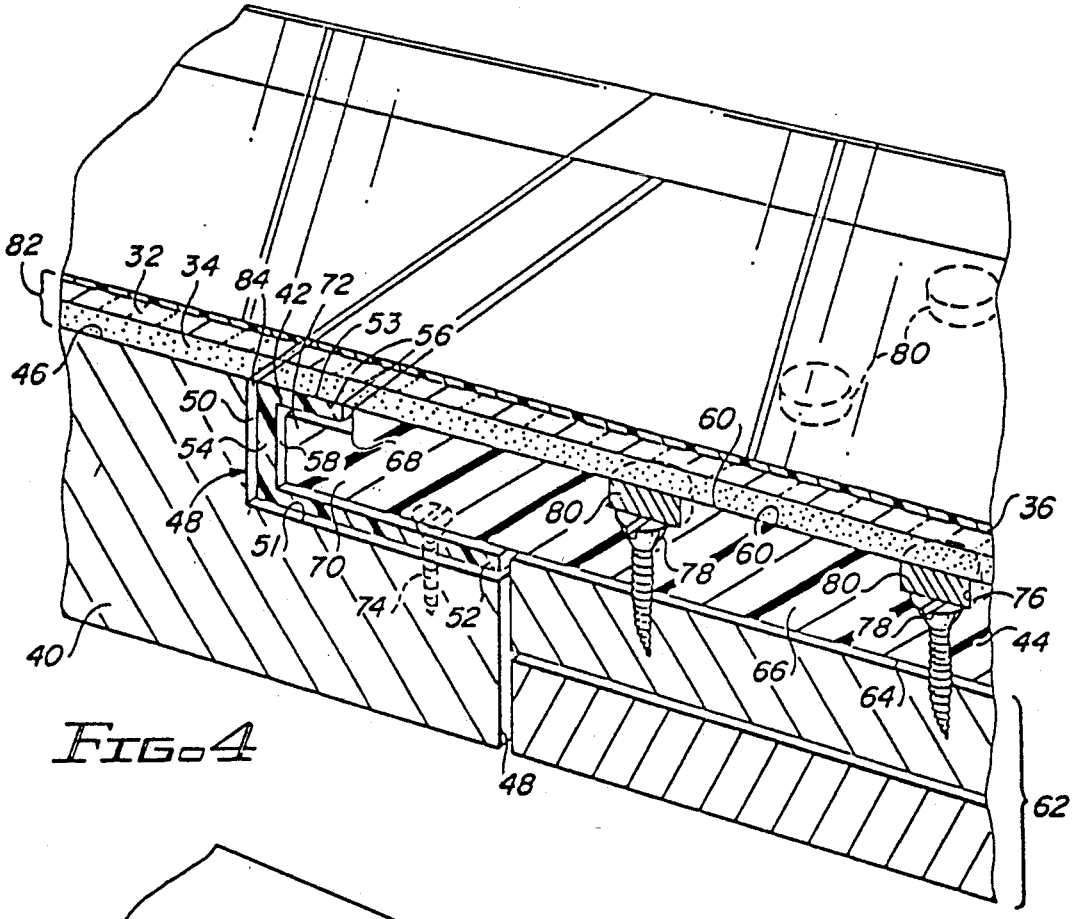
FIG. 4 is an alternate embodiment of the bowling lane shown in FIG. 3 showing a cross-sectioned side view of a synthetic lane panel coupled with a foul line strip to a wood approach panel.

Referring now to FIG. 4, in accordance with the present invention a wood approach panel 40 is coupled with a J-shaped foul line coupling 42 to a synthetic lane panel 44. Wood approach panel 40 has a flat top surface 46 and a front side 48. A notch 50 is cut from a portion of approach panel 40 and extends from the top of its front side 48 to form a step 51. Resting on this step 51 is J-shaped foul line coupling 42. J-shaped foul line coupling 42 includes a flat bottom portion 52 integrally connected to a perpendicular riser portion 54. Riser portion 54 extends upwards from bottom portion 52 and terminates in a top portion 56. Top portion 56 has a flat top surface 53 that extends away from panel 40, extends perpendicular to riser portion 54 and parallel to bottom portion 52. Bottom portion 52 with riser portion 54 and top portion 56 partially enclose open portion 58. J-shaped foul line coupling 42 and bottom portion 52 rests on step 51. Flat top surface 53 is preferably coplanar with flat top surface 46 and, as discussed below, this may be achieved as necessary by shimming the bottom 52.

The J-shaped foul line coupling 42 may be constructed from a vinyl, metal, composite, or other strong material so as to withstand the impact of a bowling ball contacting flat top surface 53. The preferable dimensions of J-shaped foul line coupling 42 are as follows: Bottom portion 52 is preferably 1 ½ -inches long by ¼-inch high. The riser 54 is preferably ¾-inch high extending from the bottom of bottom portion 52 to top surface 53 and ¼-inch wide. The preferable width of top portion 56 is ½-inch with a ¼-inch height. The length of coupling 42 preferable extends from one side of the bowling lane to the other side, which is typically 42 inches wide.

Abutting wood approach panel 40 is a bowling lane substructure 62. This substructure 62 is preferably constructed using one or more plywood planks that are screwed together using standard attachment techniques. Bowling lane substructure 62 has a flat top surface 64 which is coplanar with the top surface of bottom portion 52.

Synthetic bowling lane panel 44 rests on the top surface 64 of substructure 62 and bottom portion 52 of the coupling 42. Lane panel 44 is preferably constructed from a phenolic using standard manufacturing techniques. Lane panel 44 has a top surface 60 and preferably has a notch 68 and tab 70 which are cut out of the lane panel to form a step 72 as previously described in connection with FIGS. 1 through 3. Step 72 is inserted into the open portion 58 of foul line coupling 42 so that lane panel 66 abuts on one side of riser portion 54 and the other side of riser portion 54 abuts wood approach panel 40. When step 72 is inserted into foul line coupling 72, it is preferable that the top surface 53 be coplanar with top surface 60.

J-shaped foul line coupling 42 is attached to wood approach panel 40 using a plurality of screws 74. Screws 74 are preferably evenly spaced six to twenty-four inches apart through the bottom portion 52 from one side of the bowling lane to the other.

Bowling lane panel 44 includes a plurality of apertures 76 which extend through the lane panel 44. Screws 78 are inserted through apertures 76 to connect bowling lane panel 4 to bowling lane substructure 62. After screws 78 have been inserted through lane panel 44, dowels or a seam fill 80 are placed on top of screws 78, and have a flat top surface which is coplanar to the flat top surface 60.

Referring again to FIG. 4, an elongated flexible sheet 82 extends over top surface 60 and wood approach panel 40 and includes a clear plastic film barrier 32 and a contact adhesive 34. The plastic film barrier 32 is attached over the approach panel 40, foul line coupling 42, lane panel 44 and dowels 80 using the techniques described in connection with FIGS. I through 3. It is recognized that by placing a clear plastic film barrier 32 over the location where bowling lane panel 44, coupling 42 and approach panel 40 abut, moisture and contaminants are prevented from falling into groove 84. Thus, approach panel 40 is prevented from swelling and shimmying between the panels is reduced.

It is also recognized that J-shaped fouling coupling 42 is ridged, thereby maintaining top surface of lane panel 44 coplanar to the top surface of wood approach panel 40. Accordingly, panels of different materials may be connected in the same bowling lane without shimmying.

Clear plastic film barrier 32 extends across dowels 80, aperture 76 and bowling lane 44. This clear film barrier 32 is held in place with a contact adhesive 34. The adhesive 34 and film barrier 32 combination serves a dual purpose when used on lane panel 44. First, the film barrier 32 protects the bowling lane panel 44 from contaminants falling into aperture 76; second, film barrier 32, in combination with contact adhesive 34, holds dowels 80 in place during bowling and prevents these dowels from popping up.

After the bowling lane has been constructed, one side of flexible sheet 82 is securely attached to approach panel 40 and lane panel 44. The other side of flexible sheet 82 is coated with lane finish material 36 The technique for coating this finish material 36 was described previously in connection with FIGS. through 3.

Figure 5:
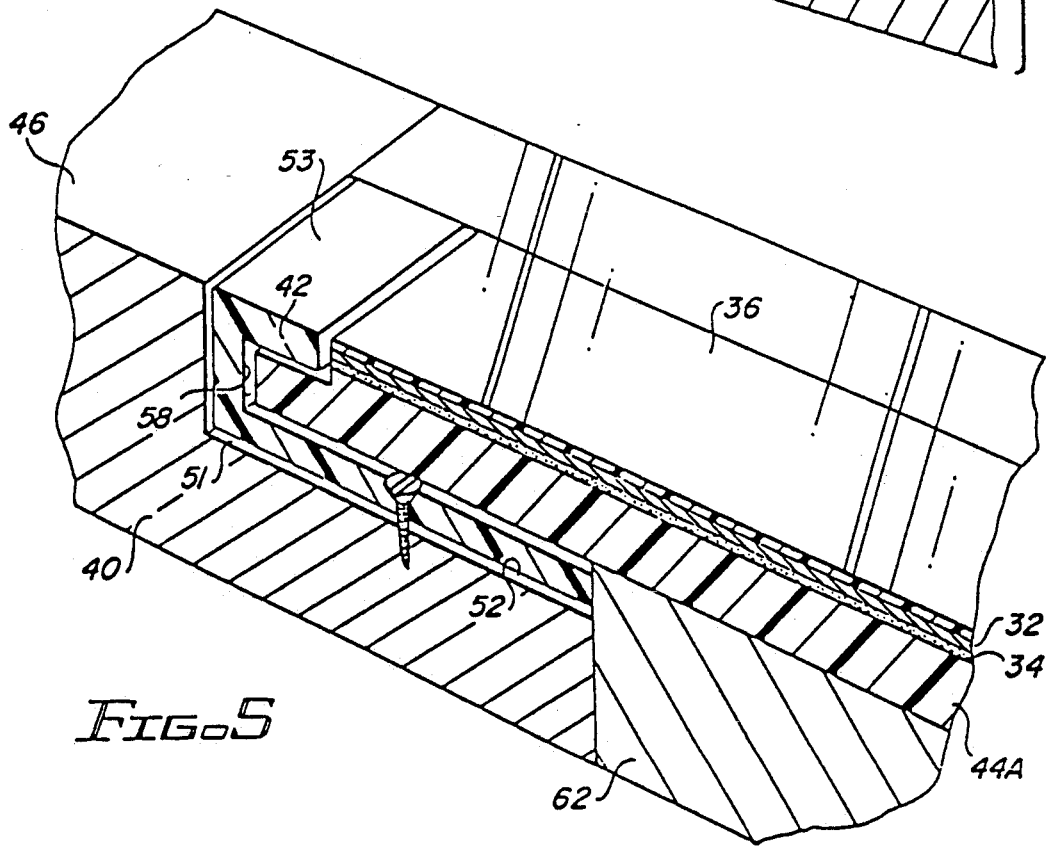
FIG. 5 is a cross-sectioned side view of an alternate embodiment of the bowling lane shown in FIG. 4, with the synthetic lane panel having a top surface at a different level than the top surface of the foul line strip.

Referring now to FIG. 5, there is shown an alternate embodiment of a bowling lane having a synthetic lane panel 44A that is different than lane panel 44 shown in FIG. 4. In FIG. 5, approach panel 40 is coupled to synthetic lane panel 44A with foul line coupling 42 to form a contiguous bowling lane. Foul line coupling 42, as in FIG. 4, rests on the step 51 notched in approach panel 40. Approach panel 40 has a flat top surface 46 that aligns with the flat top surface 53 of foul line coupling 42. However, top surface 60 in FIG. 5 is not coplanar with the top surface 53 of foul line coupling 42; instead the level of top surface 60 is below that of top surface 53 and forms a step-up junction with the top surface 53 of coupling 42.

Synthetic lane panel 44A rests on a substructure 62 and the bottom portion 52 of the coupling 42. The synthetic lane panel 44A also forms a step 45 at one end that extends into open portion 58 of foul line coupling 42. A plastic film barrier 32 is attached to the top surface 60 with contact adhesive 34, using the methods previously described. In this configuration, plastic film barrier 32 does not extend onto the top surface 53 of foul line coupling 42, preventing the plastic film 32 from tearing when a bowling ball strikes the synthetic lane panel 44A during use. It is also preferable that a lane finish material 36 be applied over the plastic film barrier 32, and that the top surface of lane panel 44A with finish material 36 be coplanar with top surface 53 and top surface 46.

Figure 6:
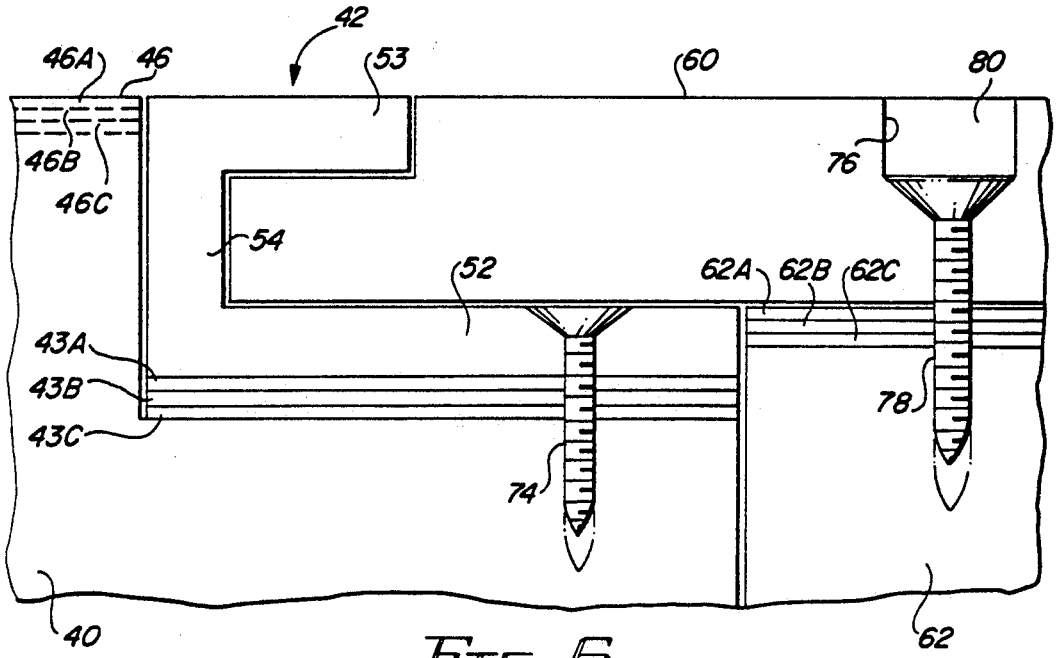
FIG. 6 is a side view of an alternate form of the bowling lane shown in FIGS. 4 and 5, and in which cross-hatching has been omitted, for purposes of clarity in understanding the process in which the system of FIG. 6 is used.

Another form of an arrangement useful in coupling an approach panel to the bowling lane is depicted in FIG. 6. While FIG. 6 is a cross-sectional view, cross hatching has been omitted in that figure for purposes of illustrating the manner in which the coupler construction shown there is used to correct the vertical height of the joint coupler as the approach lane 40 is successively refinished to remove a portion of the top surface 46 for refinishing the approach in successive refinishing operations at spaced time intervals. Thus, if the approach panel 40 is refinished at its upper surface 46 to remove portions 46A, then 46B and then 46C (as is often done) then it would be appreciated that the upper level of the joint coupler 42 and the upper surface 60 of the lane panel 44 will be out of plane with respect to the upper surface 46 of the approach panel 40. To permit vertical adjustments in the height of the joint coupler 42 and the lane panel 44 consistent with the removal of portions of the upper surface 46 of the approach panel 40, the joint coupler 42 is provided with shims 43A, 43B and 43C each of which has a dimension on the order of preferably about 20 mils in thickness, which corresponds to the amount of wood which would typically be removed from the top surface 46 of the approach panel 40, as represented by the portions 46A–46C. The fastener 74 extends through the bottom portion 52 of the joint coupler 42 and into the approach panel 40. Likewise, there is provided shims 62A, 62B and 62C between the adjacent end of the lane panel 44 and the underlying substructure 62, each of which shims 62A–62C would be removed at a corresponding time as shims 43A–43C. Of course, fastener 78 extends through all of the shims 62A–62C to fasten those shims together with the approach panel 44 and the substructure 62.

Figure 7:
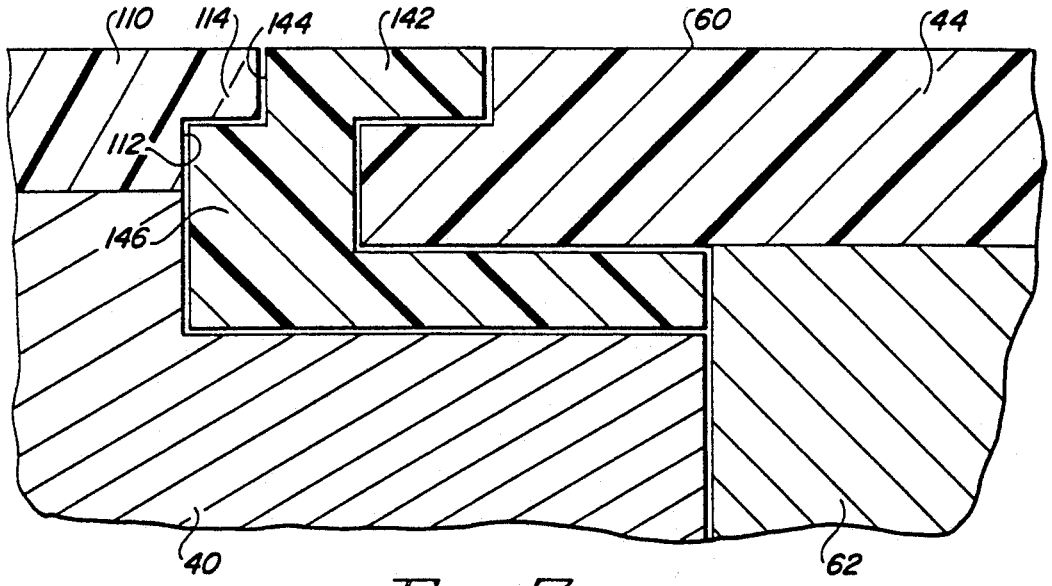
FIG. 7 is another form of a bowling lane employing a coupler, like that shown in FIGS. 4–6.

Yet another form of the joint coupler arrangement is shown in FIG. 7. There, the joint coupler 142 has particular applicability for use with a synthetic lane panel 44 and a synthetic approach panel 110, and in which a sufficient portion of the approach panel 40 has been removed in order to permit the synthetic approach panel 110 to fit thereon. The synthetic approach panel 110 includes a notch 112 and tab 114, which interfaces with a corresponding notch 144 and tab 146 in the side of the joint coupler 142 opposite from the lane panel 44.

Figure 8:
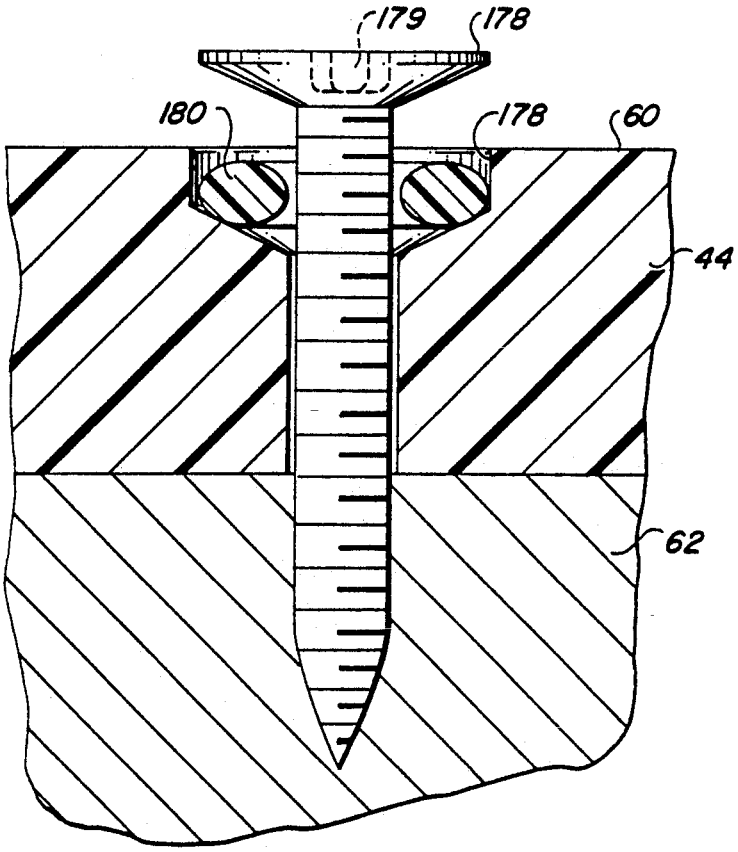
FIGS. 8 and 9 are cross-sectional side views illustrating a compressible fastener system in accordance with the present invention.
Figure 10:
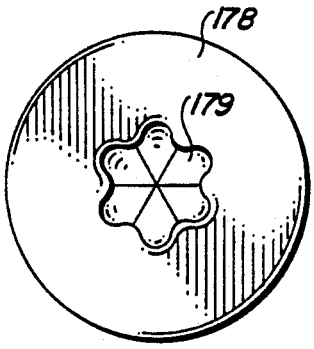
FIG. 10 is a top view of the fastener illustrated in FIGS. 8 and 9.
Figure 9:
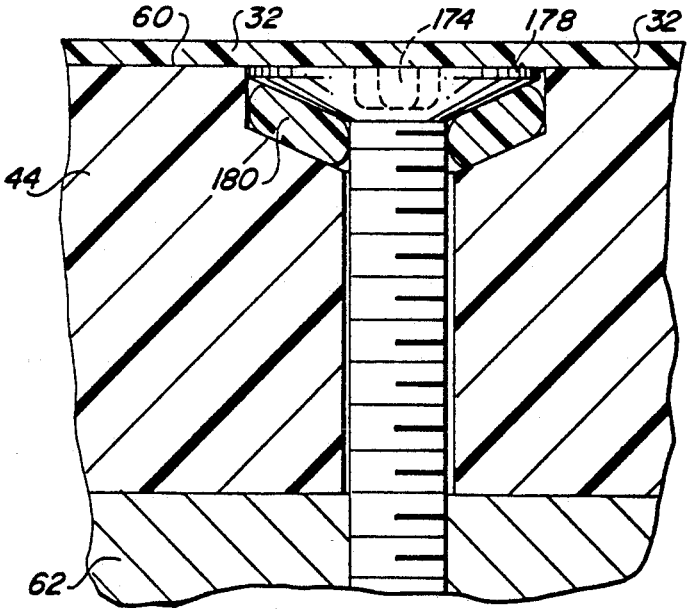

Turning now to FIGS. 8–10, there is shown a compressible fastener system having utility in avoiding the need for the dowels 80 shown and described above. In the construction of FIGS. 8–10, the synthetic panel, such as lane panel 44, has a countersink 176 extending from its top surface 60, and with a compressible gasket ring 180 placed in the countersink. A fastener 178 of the torque drive variety is utilized, and employs a recess socket 179 into which a torque drive can be fitted. (Note FIG. 10). In use, the fastener is driven a sufficient distance to ensure that the surface of its head is in plane with the top surface 60 of the panel 44, which is achieved by compression of the gasket 180. The use of this compression technique avoids any dimensional misalignments with respect to the depth of the countersink, and permits the head of the fastener 178 to lie flush with the surface 60. After all of the fasteners 178 are inserted into the panel 44, the clear plastic sheet 32 may be adhered to the surface 60 in the manner described above.

This concludes the description of the preferred embodiments. A reading by those skilled in the art will bring to mind various changes without departing from the spirit and scope of the invention. It is intended, however, that the invention only be limited by the following appended claims.

What is claimed is:

1. A method for constructing a bowling lane having a joint between an approach panel and a lane panel, the method comprising the steps of:

providing an approach panel having a top surface, a bottom surface and an edge extending in a substantially straight line from one side of the approach panel to the other;

forming a notch in the approach panel along its edge, so that its edge forms a tab between the top and bottom surfaces of the approach panel;

providing a lane panel having a top surface, a bottom surface and an edge extending in a substantially straight line from one side of the lane panel to the other;

forming a notch in the lane panel along its edge, so that its edge forms a tab between the top and bottom surfaces of the lane panel; and inserting a joint coupler between the edges and juxtapositioning the panels so that the tab of one mates with the notch of the second panel and the tab of the second panel mates with the notch of the first panel, with the joint coupler therebetween.

2. The method as recited in claim 1 further comprising the step of attaching a clear layer onto the top surfaces of the approach and lane panels and over the joint between the panels.

3. The method recited in claim 1, wherein the joint coupler comprises an elongated bottom portion and a riser portion extending generally normal to the bottom portion, the joint coupler inserting step comprising the step of fastening the bottom of the joint coupler to the tab of the approach lane with the riser extending along the notch of the approach lane.

4. The method recited in claim 3 wherein the joint coupler further comprises a top portion extending normal to the riser portion and generally parallel to the bottom portion, further comprising the step of extending a part of one of the lanes under the top portion of the joint coupler.

5. The method recited in claim 4, wherein the top and bottom portions define a joint opening between them, and further comprising the step of inserting the tab of the lane panel into the joint opening.

6. The method recited in claim 3 further comprising the step of depositing protective layer means over at least the top surface of the lane panel.

7. The method recited in claim 6 further comprising the step of depositing the protective layer means with an outer surface lying co-planar with the top surface of the approach panel and the top of the joint coupler.

8. The method recited in claim 6 further comprising the steps of dimensioning the approach panel, the lane panel and the joint coupler with all of their top surfaces lying co-planar, and depositing the protective layer means over all of the co-planar top surfaces.

9. The method recited in claim 1 further comprising the step of inserting at least one of horizontal shim between the joint coupler and one of the lanes.

10. The method recited in claim 9 further comprising the steps of removing the one shim and lowering the joint coupler.

11. The method recited in claim 3 further comprising the steps of:

inserting a plurality of elongated shims under the bottom portion of the joint coupler; and thereafter successively removing one or more shims at spaced time intervals as needed to lower the joint coupler and conform its vertical dimension to that of the adjacent panels.

12. The method recited in claim Il further comprising the steps of:

inserting a corresponding plurality of shims under the edge of the lane panel; and successively removing one or more of the lane panel shims at the spaced time intervals to conform the top surface of the lane panel with that of the joint coupler and the approach panel.

13. The method recited in claim 12 further comprising the step of removing a portion of the approach panel at the top surface at each of the successive time intervals.

14. The method recited in claim 2 further comprising the steps of:

forming countersinks in the lane panel;

placing a compressible gasket in each countersink;

extending a fastener into each countersink which is dimensioned to mate therewith and driving each fastener through the lane panel and into engagement with a substructure under the lane panel while compressing the corresponding gasket until the head of the fastener lies flush with the top surface of the lane panel; and thereafter attaching the clear layer over the top surface of the lane panel.

15. A method for constructing a synthetic bowling lane, the method comprising the steps of:

providing a bowling lane substructure;

providing a synthetic bowling lane panel with a top surface and having a plurality of apertures penetrating partially into the panel from the surface;

attaching the synthetic panel to the substructure with screws inserted into the apertures;

inserting a dowel having a flat head into each aperture over the corresponding screw so that each dowel is flush with the top surface;

providing a clear flexible sheet having a uniform thickness and a layer of contact adhesive secured to one side of the sheet;

placing the flexible sheet with the adhesive side down over the panel and the dowels; and pressing the flexible sheet against the floor to securely adhere the sheet to the dowels and the top surface of the panel.

16. The method recited in claim 15 further comprising the step of coating the flexible sheet with a finish material and curing the finish material to form a hardened surface.

* * * * *